US007124477B2

(12) United States Patent
Boland

(10) Patent No.: US 7,124,477 B2
(45) Date of Patent: Oct. 24, 2006

(54) BALL CHAIN AND CONNECTOR FOR TESSELLATED PATTERNS

(76) Inventor: Paul E. Boland, 1863 Falcon Wood Dr., Marietta, GA (US) 30066

( * ) Notice: Subject to any disclaimer, the term of this patent is extended or adjusted under 35 U.S.C. 154(b) by 0 days.

(21) Appl. No.: 11/033,657

(22) Filed: Jan. 12, 2005

(65) Prior Publication Data

US 2005/0199008 A1 Sep. 15, 2005

Related U.S. Application Data

(60) Provisional application No. 60/551,544, filed on Mar. 9, 2004.

(51) Int. Cl.
*A44B 21/00* (2006.01)

(52) U.S. Cl. ..... 24/116 A; 245/4; 70/457

(58) Field of Classification Search ..... 63/37; 24/574.1, 116 A; 403/305, 217, 218, 219; 59/81, 91; 245/4, 7–9; 174/138 B; 70/457
See application file for complete search history.

(56) References Cited

U.S. PATENT DOCUMENTS 689,232 A * 12/1901 Schoch ..... 63/37
1,259,388 A 3/1918 Gagnon
1,646,999 A 10/1927 Goodridge
1,692,649 A * 11/1928 Goodridge et al. ..... 24/116 A
RE17,970 E 2/1931 Cook
1,814,710 A 7/1931 Komorous
2,557,970 A 6/1951 Jablon ..... 206/79
3,120,042 A 2/1964 Speranza et al. ..... 24/123
3,200,434 A 8/1965 Jarnot ..... 16/86
3,335,468 A 8/1967 Harley ..... 24/123
3,458,993 A 8/1969 Greene ..... 59/35
3,979,802 A 9/1976 Bongartz et al. ..... 24/213
5,014,400 A 5/1991 Ban ..... 24/108
5,509,181 A 4/1996 Yuuki et al. ..... 24/116

* cited by examiner

*Primary Examiner*—Jack W. Lavinder
(74) *Attorney, Agent, or Firm*—Thomas, Kayden, Horstemeyer & Risley, LLP

(57) ABSTRACT

A ball chain assembly may be used to form tessellated patterns of ball chains. The ball chains include a series of balls and intermediate links of a breadth less than the breadth of said balls. A chain connector of one-piece construction defines a circular array of ball-receiving sockets. Each of the sockets are sized to receive a ball of one of said chains. A ball of the chain can be inserted into one of the sockets of the chain connector where a link of the inserted ball passes through the slot extending from the socket, such that a chain can be connected to each of the sockets.

20 Claims, 6 Drawing Sheets

BALL CHAIN AND CONNECTOR FOR TESSELLATED PATTERNS

CROSS-REFERENCE TO RELATED APPLICATION

Applicant claims the benefit of copending U.S. provisional patent application entitled "Connector Coupling Configured To Easily Employ More Than Two Ball Chains" filed on Mar. 9, 2004 and accorded Ser. No. 60/551,544, which is entirely incorporated herein by reference.

FIELD OF THE INVENTION

The present invention relates to a ball chain assembly, particularly to a chain connector configured to connect more than two ball chains. The ball chain includes a series of balls inter-connected by intermediate links, and the chain connector has sockets for receiving the balls of the chains to allow for the formation of patterns by the chains, including tessellated patterns.

BACKGROUND OF THE INVENTION

Ball chains are presently used as light weight yet strong chains for holding various objects, particularly keys and other small objects carried together in a purse or pocket. The ball chains are formed by a series of balls inter-connected by intermediate links. A chain connector is used to connect the free ends of the chains. The chain connector usually is one piece of steel formed into a ball-receiving slotted tube with sockets at its opposite ends, so the balls at the ends of the chain can be moved into the sockets with the links passing through the slots.

The chain connector is an element that has a central aperture through which the terminal ball of a ball chain is inserted. This central aperture is connected by narrow slits at each end of the chain connector to end openings, and after each terminal ball is inserted in the central aperture, it is pulled to a mounted position at one end of the chain connector by sliding the link attached to the ball through the respective slit until the link extends through the end opening. The slit is slightly narrower than the diameter of the link so that it resists movement of the ball back toward the central aperture and thereby retains the chain end in coupled position within the chain connector. Such chain connectors have been known and widely used. Although this type of chain connector has been known, it does not provide for more than two connections. Further, it does not allow a user to easily modify the existing ball chain connections.

Other prior art disclosures describe chain connectors for ball chains that can connect more than two ends of ball chains, such as disclosed in U.S. Pat. Nos. 1.259,388, Re. 17,970, 1,814,710, and 2,557,970, but they are formed of more than one piece of material and/or do not allow for easy connection and disconnection of the chains.

Thus, a heretofore unaddressed need exists in the industry to address the aforementioned deficiencies and inadequacies.

SUMMARY OF THE INVENTION

The present invention includes a ball chain assembly that has at least one ball chain and a chain connector that may be used for connecting several ends of ball chains. Each ball chain includes a plurality of balls and links of a breadth less than the breadth of the balls, with the links positioned intermediate adjacent ones of the balls and connecting the balls in series. The ball chains that are received in the chain connector may be formed in tessellated patterns of chains with duplicate ball chain assemblies connected to one another.

The chain connector may be formed of one-piece construction having opposed front and rear surfaces, a center, and a perimeter surface surrounding said center. The chain connector defines an array of ball-receiving sockets spaced from the center, positioned about the perimeter surface. The ball-receiving sockets are equally spaced from one another at the perimeter surface, and sized to receive the balls of the chains. The chain connector also defines an array of slots with each slot extending from a socket outwardly through the perimeter surface of said chain connector and sized to receive a link of the ball chain.

A ball of a ball chain is inserted into one of the sockets of said chain connector with a link of the inserted ball passing through the slot extending from the socket, such that the terminal balls of the chains can be received in the sockets and the chains extended radially from the chain connector.

The ball chain connector can be constructed of spring metal, plastic, nylon, Teflon®, stainless steel, aluminum, tin, and other materials that are strong enough to maintain their shape for the intended purpose.

One embodiment of the chain connector is a monolithic molded chain connector. A second embodiment of the chain connector is formed of sheet material. In the second embodiment, the ball chain connector includes multiple petals radiating from the central area. These multiple petals are folded over the central area to form a multi-sided polygon defining an inner space with a central aperture. The inner space is large enough to accommodate the terminal balls of multiple chains into the interior of the main body.

In both of the above mentioned embodiments a central aperture is formed that can receive a lock button that spans the passage into the sockets and locks the balls in the sockets.

The device may be formed as a disc, sphere, oval or other circular shape, or as a multi-sided polygon shape such as a triangle, square, hexagon, or any multi-sided polygon, having sockets for receiving the terminal balls of ball chains, with slots extending from the sockets to the perimeter surface of the chain connector.

The terminal balls in multiple ball chains are moved into the sockets of the chain connector, the links of the terminal balls are pushed through the slots of the sockets, and the lock button may be inserted in the central opening of the chain connector to lock the terminal balls in their sockets.

The chain connector can be constructed to accommodate any size ball chain by scaling the body to accommodate each differently sized terminal ball.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

The components in the drawings are not necessarily to scale relative to each other.

DETAILED DESCRIPTION

Figure 1:
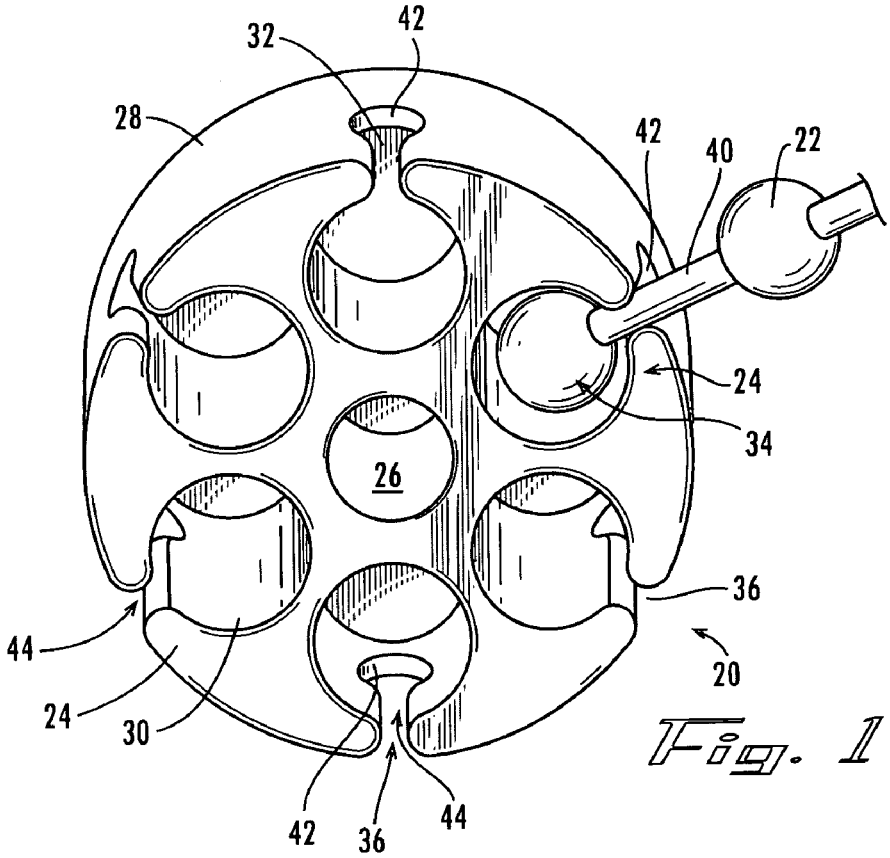
FIG. 1 is a perspective view of a one-piece monolithic ball chain connector having six ball receiving sockets.

Referring now in more detail to the drawings, in which like numbers refer to like parts throughout the figures, FIG. 1 shows a one-piece ball chain connector 20 that is a single piece structure configured to receive the terminal ball 34 of up to six ball chains, such as ball chain 22. The chain connector 20 is a one piece molded monolithic structure. The ball chain connector 20 defines an array of ball-receiving sockets 24 surrounding the central aperture 26, with the ball-receiving sockets located at the perimeter surface 28 of the chain connector 20. Each of the ball-receiving sockets are shaped to receive a terminal ball of a ball chain, such as in a substantially cylindrical configuration 30 that merges into a semi-spherical end point or bottom surface 32.

Also included in ball chain connector 20 are securing mechanisms in the form of slots 36 that extend from each socket 24 to the perimeter surface 28 and allow for insertion of the links 40 extending from the terminal balls 34 that were inserted in the sockets. Slots 36 secure the ball chain 22 by receiving the terminal ball 34 of ball chain 22 in ball-receiving socket 24 and the link 40 extending to the terminal ball of the ball chain 22 is received by the bulbous portion 42 of slot 36. When the link of ball chain 22 passes through the narrow slit portion 44 of slot 36, the link of the chain is secured in the bulbous portion 42 of slot 36.

Figure 2:
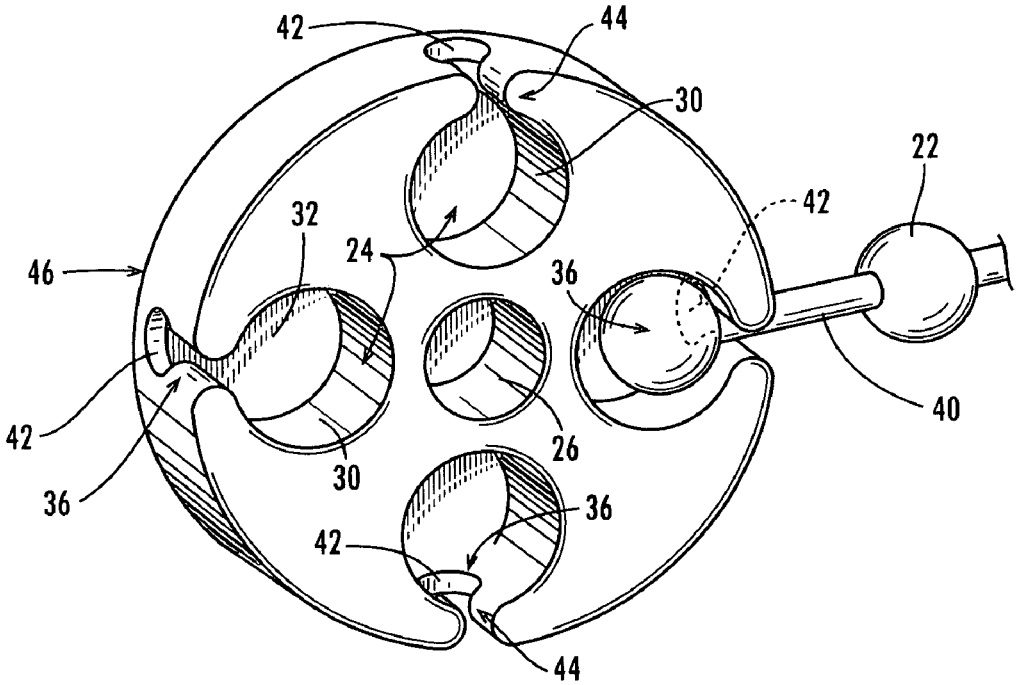
FIG. 2 is a perspective view of an alternate embodiment of the monolithic chain connector of FIG. 1, having four ball receiving sockets.

FIG. 2 shows a similar monolithic one-piece ball chain connector 46 that is similar to the chain connector of FIG. 1, but has four ball-receiving sockets 24 that have the same cylindrical configuration portion 30, and semi-spherical configuration portion 32 as the chain connector of FIG. 1. Also included in this representation of one-piece ball chain connector 46 is central aperture 26 and slot 36, which includes bulbous portion 42 and narrow slit portion 44. Preferably, the number of sockets formed in the chain connector may be 3, 4, 6 or 8, all of which can be used to form tessellated patterns of ball chain structures. But any number of ball-receiving sockets may be included in the ball chain connector without diverging from the essence of this description.

Figure 3:
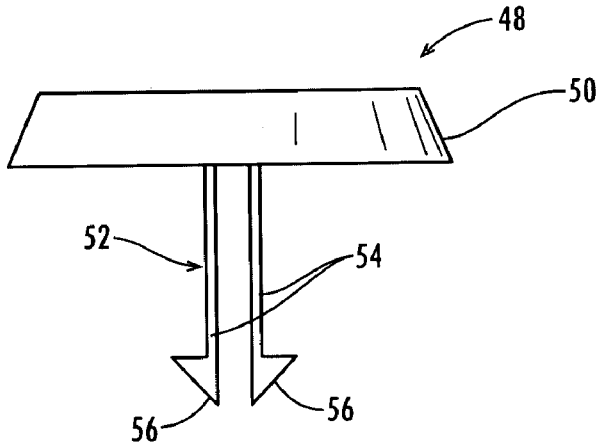
FIG. 3 is a side view of a lock button that is inserted into the central aperture of a ball chain connector of FIGS. 1 and 2.
Figure 5:
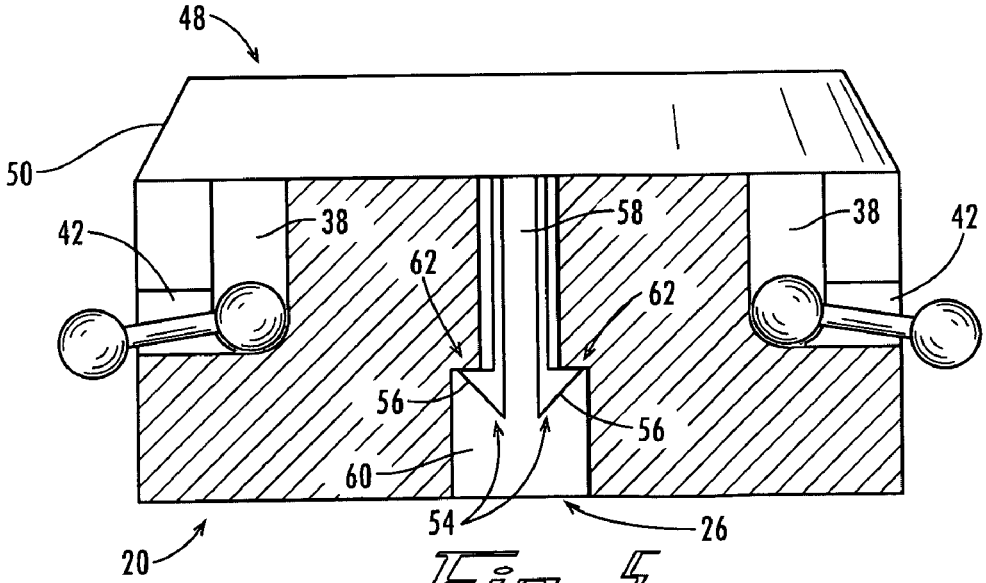
FIG. 5 is a cross-sectional view of the ball chain connector of FIG. 1, with the lock button of FIG. 3 attached by the inner locking edges.

FIGS. 3 and 5 show an ornamental lock button 48 that can be included for covering at least one surface of the one-piece ball chain connectors 20 and 46 (FIGS. 1 and 2). The ornamental lock button 48 is removably attached to the chain connector and is used to both lock the balls in their sockets and to hide ball-receiving sockets to provide a more aesthetic view of the one-piece ball chain connector 46.

FIG. 3 is a side view of the ornamental lock button 48, which can be inserted into central aperture 26 of a chain connector of FIGS. 1 and 2. As shown in FIG. 3, lock button 48 includes an ornamental button 50 and locking mechanism 52. Ornamental button 50 can take the form of a decorative piece or it may also simply cover the portion of the ball chain in the chain connector to provide a more aesthetic view of the ball chain assembly 20 of FIGS. 1 and 2. The lock mechanism of the ornamental lock button 48 is formed in parallel anchor prongs 54 with triangular anchors 56. As the anchor prongs 54 are inserted into the central aperture of monolithic chain connector 20 (FIG. 5), the two prongs of locking mechanism 52 are pushed together by the sloped surfaces of the anchor prongs 54 engaging the surface of the opening until the anchors 56 pass the narrow portions of the chain connector and spring back and become locked in place by triangular anchors 56.

Figure 4:
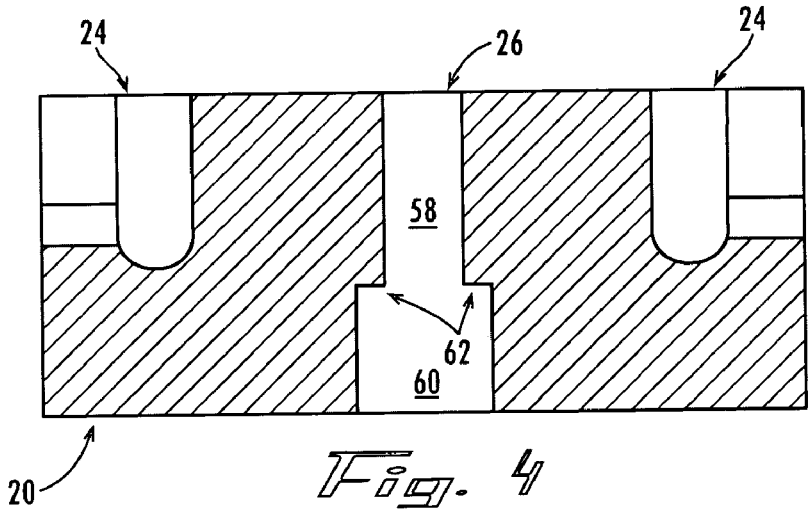
FIG. 4 is a cross-sectional view of the ball chain connector of FIG. 1.

FIG. 4 is a cross-sectional view of the one-piece monolithic ball chain connector 20 of FIG. 1 and illustrates ball-receiving sockets 24 and central aperture 26. FIG. 4 further illustrates a narrow segment 58 and a wide segment 60 of central aperture 26 that form inner locking edges 62. The triangular anchors 56 are biased outwardly behind the edges 62 so as to lock the ornamental lock button in place, as shown in FIG. 5. The button 50 of the lock button 48 (FIGS. 3 and 5) that is used with the monolithic chain connector 20 is large enough to at least partially cover the sockets of the monolithic chain connector, and to lock the balls of the ball chain in the sockets of the chain connector. Both the four socket and the six socket monolithic ball chain connector of FIGS. 1 and 2 have their central aperture shaped the same as shown in FIG. 4 and the lock button 48 functions with both chain connectors.

FIG. 5 shows the lock button 48 inserted in the ball chain connector 20 with the lock button 48 attached by the inner locking edges 62. The lock button 48 covers the ball-receiving sockets 24 (FIG. 4), to make the ball chain assembly more aesthetically pleasing. In addition, triangular anchors 56 of prongs 54 are inserted into the narrow segment 58 of central aperture 26. As is evident, narrow segment 58 of central aperture 26 should be constructed such that the two triangular anchors 56 of locking mechanism 52 (FIG. 3) are forced together when inserting locking mechanism 52 into the central aperture 26. When locking mechanism 52 is fully inserted into central aperture 26, the triangular anchors 56 should find wide segment 60 of central aperture 26. This allows the locking mechanism 52 to return to its normal shape behind the locking edges 62, thereby securing lock button 48 by the connection of locking mechanism 52 and inner locking edges 62. As is evident, lock button 48 may be removed by forcing triangular anchors 56 together and forcing the locking mechanism 52 out of central aperture 26 through narrow segment 58.

Since the lock button 48 holds the terminal balls 34 in their ball receiving sockets 24, it is not essential that the slots 36 are formed with their bulbous portions 42 for assuring that the links 40 are captured in the slots 36 (FIGS. 1 and 2).

Figure 6:
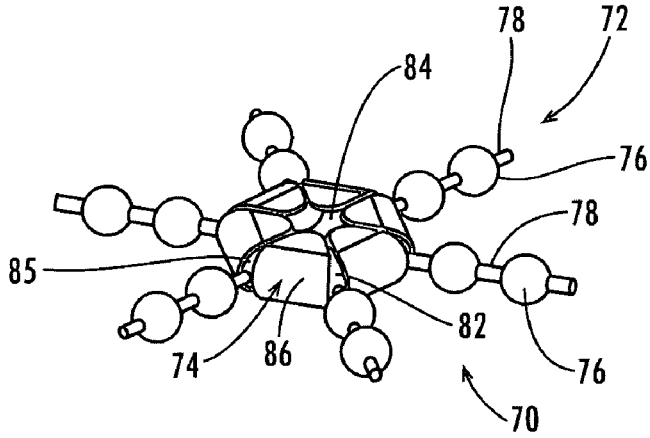
FIG. 6 is a perspective view of a hexagonal ball chain connector formed of sheet material and a plurality of ball chains connected at their ends to the chain connector.
Figure 9:
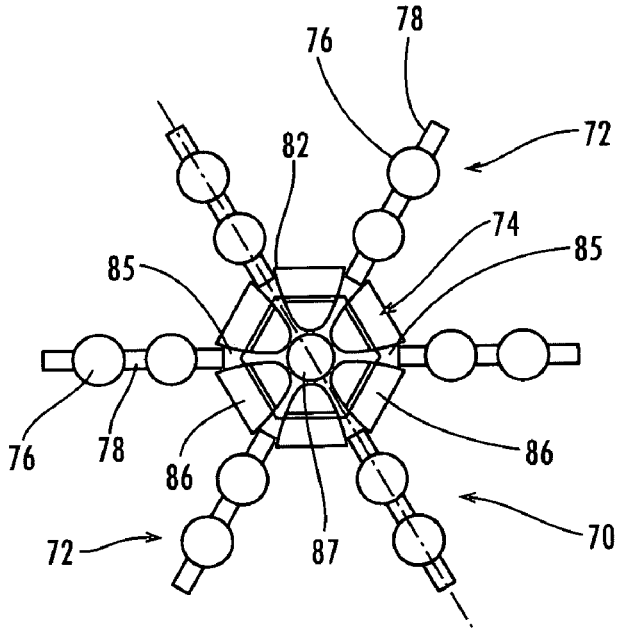
FIG. 9 is a plan view of the ball chain assembly of FIG. 6.

FIGS. 6 and 9 are perspective views of another ball chain assembly 70. Ball chain assembly 70 includes ball chains 72 and hexagonal ball chain connector 74 in a petal configuration. The ball chains 72 each include a plurality of balls 76 connected to one another with intermediate links 78. The chain connector 74 is formed of sheet material that is rigid enough to hold its shape but flexible enough to allow the links between the balls 76 of the chain to pass through the slots 85 between the petals 86 of the chain connector, such as stainless steel. The ball chains can be secured in the hexagonal ball chain connector 74 by a user inserting a ball of the chain 72 into a ball-receiving socket 82 formed by the edges of adjacent petals 86 and by moving the link of the inserted ball through the slot 85 between the petals 86. A central aperture 84 is formed by the distal ends of the petals 86 of the chain connector 74 that will receive the stem of the ornamental lock button of FIG. 10.

Figure 7:
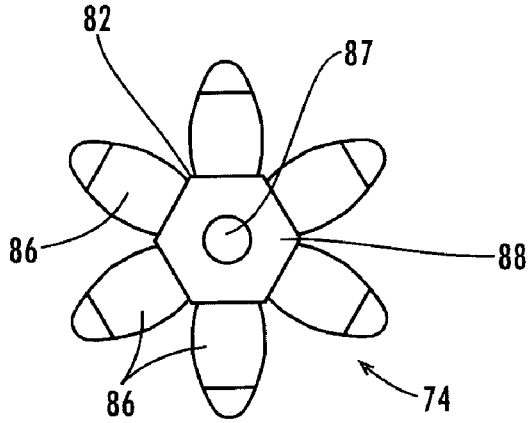
FIG. 7 s a layout view of a hexagonal ball chain connector of FIG. 6.

FIG. 7 is a two dimensional layout view of a hexagonal ball chain connector with petal configuration of FIG. 6.

Figure 8:
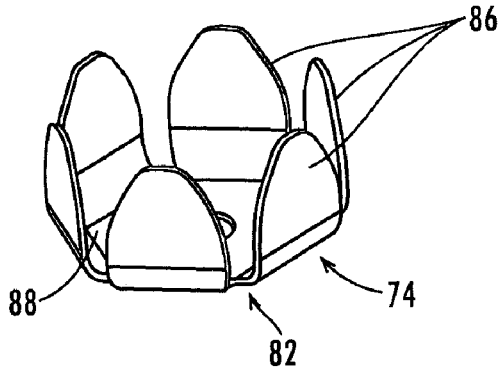
FIG. 8 is a perspective view of the ball chain connector in a partially formed configuration, progressively from the FIG. 7 configuration to the FIG. 6 configuration.

FIG. 8 is a perspective view of the ball chain connector of FIG. 6 in a partially open configuration. As shown in FIG. 8, petals 86 are in a vertical position respective to base 88 before being reformed into the closed configuration of FIG. 6. A circular opening 87 is formed in the center of base 86. FIG. 8 also illustrates how ball-receiving sockets 82 are formed during the reshaping of the chain connector as the connector is being manufactured.

FIG. 9 is a plan view of ball chain assembly 70 of FIG. 6.

Figure 10:
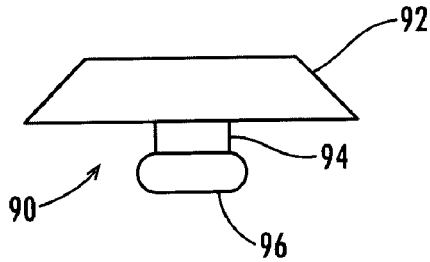
FIG. 10 is a side view of the ornamental lock button that engages the sheet metal chain connector of FIGS. 6-9.

FIG. 10 illustrates an ornamental lock button 90 that can be used with the ball chain connector of FIGS. 6 and 9. Lock button 90 has an exterior ornamental button 92, a stem 94 extending from the button and a bulbous locking element 96. The lock element 96 is inserted through the central aperture 84 of the chain connector and snaps in place.

Figure 11:
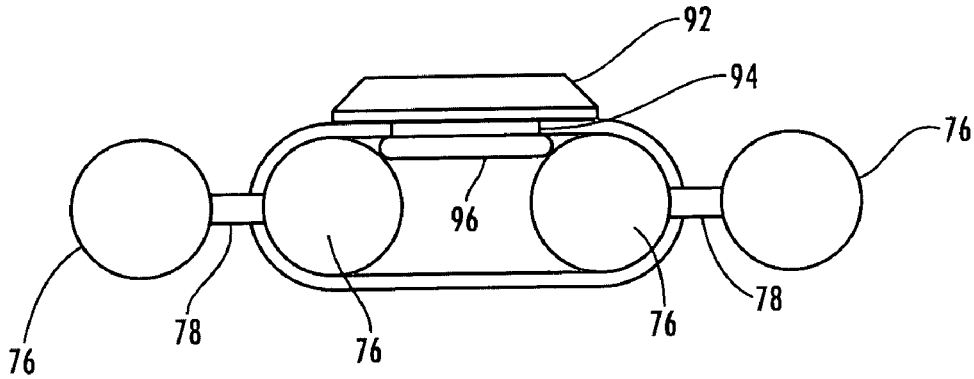
FIG. 11 is a side cross-sectional view of the chain connector of FIGS. 6 and 9 with the lock button of FIG. 10 engaged and locking the end balls of the chains in the chain connector.

As shown in FIG. 11, the bulbous locking protrusion 96 of ornamental lock button 90 (FIG. 10) is sized to require the resilient petals 86 of the ball chain connector 74 (FIGS. 6 and 9) to flex outwardly when the lock button 90 is urged through the central aperture 84 (FIGS. 6 and 9) and the resilient petals 86 move back around the smaller stem 94 and hold the lock button 90 in place with its exterior ornamental button 92 covering the central aperture 84, thus locking the balls in the chain connector 74.

While the lock buttons 48 (FIGS. 3 and 5) and 90 have been described as being "ornamental", the outer surface of the lock buttons 48 and 90 can have any desired shape or design, including a smooth exterior surface.

Figure 12:
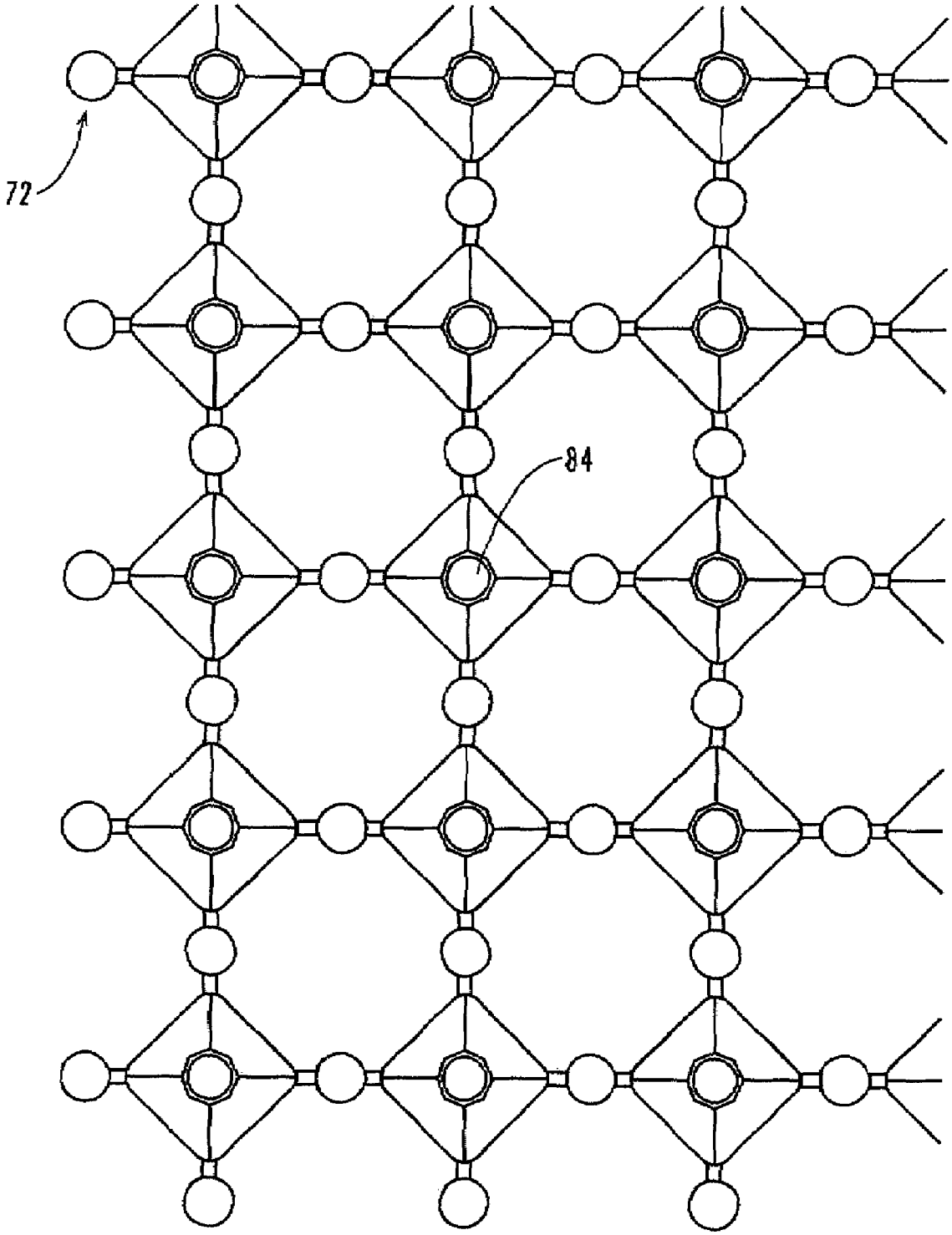
FIG. 12 is a plan view of a tessellated pattern of ball chains and connectors having four ball-receiving sockets.
Figure 13:
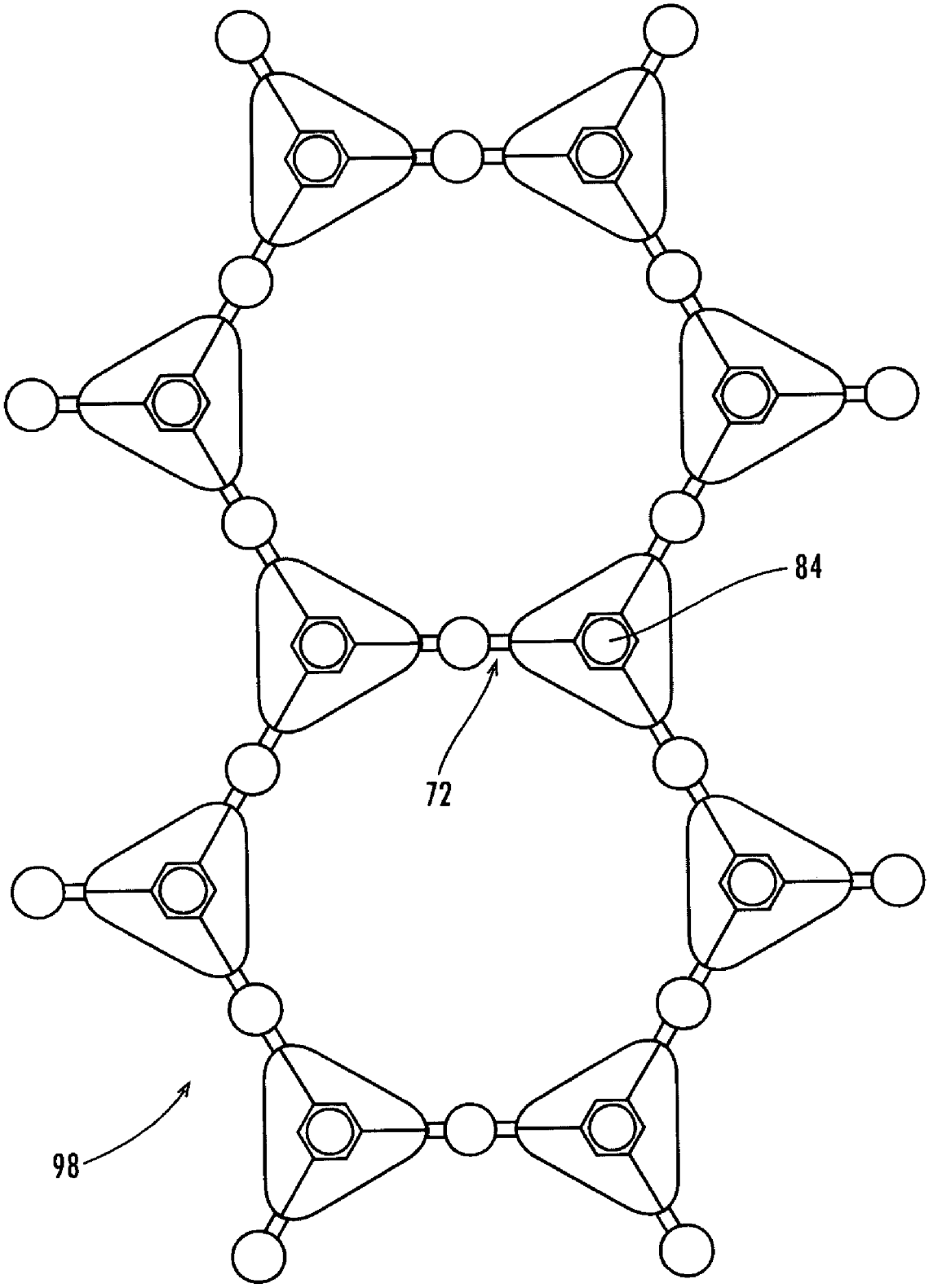
FIG. 13 is a plan view of another tessellated pattern formed with ball chains and connectors having three ball-receiving sockets.

FIG. 12 is a plan view of a tessellated pattern of ball chains formed by ball chain connectors of FIG. 2, having four ball receiving sockets, sometimes referred to as "square" chain connectors. The monolithic chain connector of FIG. 2 can be used to form the tessellated pattern of chains of FIG. 12. As should be evident, this tessellated configuration is one of a plurality of tessellated configurations that can be achieved by chain connectors having different numbers of ball receiving sockets. For example, FIG. 13 is an alternate embodiment of a tessellated pattern with triangular ball chain connectors. The tessellated pattern 98 is constructed of triangular ball chain connectors with petal configuration connected by ball chains 72.

It should be emphasized that many variations and modifications can be made to the above-described embodiments. All such modifications and variations are intended to be included herein within the scope of this disclosure and protected by the following claims.

The invention claimed is:

1. A ball chain assembly adapted to form tessellated patterns of chains with duplicate ball chain assemblies comprising:

a plurality of ball chains, each ball chain including a plurality of balls and a plurality of links of a breadth less than the breadth of said balls, with said links positioned intermediate adjacent ones of said balls and connecting said balls in series, a chain connector of one-piece construction having opposed front and rear surfaces, a center and a perimeter surface surrounding said center, said chain connector defining a circular array of at least three ball-receiving sockets, said ball receiving sockets all positioned equidistant from said center of said chain connector and equally spaced from one another at said perimeter surface, each said ball-receiving socket sized to receive a ball of one of said ball chains, said chain connector defining an array of slots with each slot extending from a socket outwardly through said perimeter surface of said chain connector and sized to receive a link of said ball chain, one of said balls of at least three of said ball chains inserted into one of said sockets of said chain connector and said links of said inserted balls passing trough said slots extending from said sockets, such that said ball chains can be connected to each of said sockets and form tessellated patterns of chains, and said chain connector defining a central aperture that intersects all of said sockets, such that said balls of said chains are passed through said central aperture to reach said sockets, and further including a lock button for insertion in said central aperture that blocks the removal of said balls of said ball chains from said sockets of said chain connector, such that the plurality of ball chains are connectable at their ends to a plurality of duplicate ones of the chain connector for forming tessellated patterns.

2. The ball chain assembly of claim 1, wherein said perimeter surface of said chain connector is cylindrical and said ball receiving sockets are positioned equidistant from said cylindrical surface.

3. The ball chain assembly of claim 1, wherein said chain connector defines at least four sockets.

4. The ball chain assembly of claim 1, wherein said chain connector defines at least six sockets.

5. A ball chain assembly adapted to form tessellated patterns of chains with duplicate ball chain assemblies comprising:

a plurality of ball chains, each ball chain including a plurality of balls and a plurality of links of a breadth less than the breadth of said balls, with said links positioned intermediate adjacent ones of said balls and connecting said balls in series, a chain connector of one-piece construction having opposed front and rear surfaces, a center and a perimeter surface surrounding said center, said chain connector defining a circular array of ball-receiving sockets, said ball receiving sockets all positioned equidistant from said center of said chain connector and equally spaced from one another at said perimeter surface, each said ball-receiving socket sized to receive a ball of one of said ball chains, said chain connector defining an array of slots with each slot extending from a socket outwardly through said perimeter surface of said chain connector and sized to receive a link of one of said ball chains, the ball of one of said ball chains inserted into one of said sockets of said chain connector and the link of said inserted ball passing through said slot extending from said socket.

such that one of said ball chains can be connected to each of said sockets, said chain connector further defining an aperture at the center of said chain connector, and a lock button having a locking mechanism sized and shaped to fit into said aperture and an ornamental button extending over said circular array of ball-receiving sockets for holding said balls of said ball chains in said sockets.

6. The ball chain assembly of claim 5, wherein said lock button has an enlarged button for placement in juxtaposition with said front surface of said chain connector and a connector stem for insertion into said central aperture.

7. The ball chain assembly of claim 5, wherein said central aperture comprises a narrow section and a wide section that define at least one inner edge, said inner edge allowing for said locking mechanism to be removably secured to said ball chain connector.

8. The ball chain assembly of claim 5, wherein said central aperture defines at least one outer edge, said outer edge allowing for a locking mechanism to be removably secured to said ball chain connector.

9. The ball chain assembly of claim 5, wherein said chain connector is a monolithic structure constructed of a material selected from a group consisting of: spring metal, plastic, nylon, tetrafluoroethylene, stainless steel, aluminum, and tin.

10. A decorative chain assembly including a plurality of ball chains, said the ball chains each including a series of balls and interconnecting links intermediate said balls, and a chain connector, the improvement therein comprising:

said chain connector having a perimeter surface, a circular array of ball-receiving sockets positioned within said perimeter surface, with each said ball-receiving socket configured to receive a ball of one of said ball chains; and a slot extending from each said ball receiving socket through said perimeter surface of said chain connector configured to secure said links extending from said ball received in said socket, a lock button having a locking mechanism configured to releasably attach to said chain connector and a button extending from said locking mechanism over said sockets of said chain connector for holding said balls of said ball chains in said sockets of said chain connector, wherein said chain connector is configured to allow a user to insert, secure, and remove said ball chain from said chain connector.

11. The decorative chain assembly of claim 10, wherein said ball receiving sockets of said chain connector are formed by petals radiating toward one another, and said slots formed between said petals sized to receive said ball chain.

12. The decorative chain assembly of claim 11, wherein said chain connector is configured to secure said ball chain between said adjacent petals.

13. The decorative chain assembly of claim 10, wherein said chain connector further defines at least one central aperture to receive at least said locking mechanism of said lock button, with said button of said locking button formed in a disc shape that extends radially from said locking mechanism over said ball receiving sockets.

14. The decorative chain assembly of claim 10, wherein said lock button is an ornamental component that is configured to extend over said ball-receiving sockets of said chain connector for blocking removal of said balls from said chain connector and for hiding said balls in said ball-receiving sockets.

15. The decorative chain assembly of claim 10, wherein said chain connector is formed in a polygon shape.

16. The decorative chain assembly of claim 15, wherein said polygon shape comprises at least one of a triangle, square, rectangle, pentagon, hexagon, octagon, and trapezoid.

17. The decorative chain assembly of claim 10, wherein said chain connector is constructed of at least one material comprising spring metal, plastic, nylon, tetrafluoroethylene, stainless steel, aluminum, and tin.

18. The decorative chain assembly of claim 10, wherein duplicate ones of said chain connector and said ball chains are configured in a tessellated pattern of said ball chains.

19. The decorative chain assembly of claim 18, wherein said chain connector is a monolithic disc shaped structure and defines a central aperture, and said ball receiving sockets and said central aperture are distinct openings, and said locking mechanism is received in and locked to said central aperture.

20. The decorative chain assembly of claim 18, wherein said chain connector is a circular structure.

* * * * *